United States Patent [19]

van der Meulen

[11] 4,295,644

[45] Oct. 20, 1981

[54] DEVICE FOR STACKING THIN-WALLED BAGS

[76] Inventor: Leonard van der Meulen, Immeuble Saadi, Apt. 22A, Ariana, Tunisia

[21] Appl. No.: 54,937

[22] Filed: Jul. 5, 1979

[30] Foreign Application Priority Data

Dec. 9, 1978 [NL] Netherlands ..... 7807513

[51] Int. Cl.[3] ..... B65H 39/08

[52] U.S. Cl. ..... 270/60; 270/42

[58] Field of Search ..... 270/60, 47, 48, 49, 270/50, 42, 38; 93/93 R, 93 HT, 8 R

[56] References Cited

U.S. PATENT DOCUMENTS

| | | | |
|---|---|---|---|
| 3,105,422 | 10/1963 | Simpson et al. | 270/60 X |
| 3,791,267 | 2/1974 | Brooks | 270/60 X |
| 3,921,968 | 11/1975 | Thomas et al. | 270/60 |
| 4,026,537 | 5/1977 | Harris | 270/60 X |
| 4,094,499 | 6/1978 | Thomas | 270/60 |

FOREIGN PATENT DOCUMENTS

| | | | |
|---|---|---|---|
| 2064724 | 7/1972 | Fed. Rep. of Germany | 270/60 |
| 444694 | 10/1975 | U.S.S.R. | 270/60 |

*Primary Examiner*—Edward M. Coven

*Attorney, Agent, or Firm*—Barry G. Magidoff

[57] ABSTRACT

In a machine for stacking bags manufactured from thin thermoplastic foil material, the combination of a rotatable supporting drum with radially projecting collecting pins and clenching means for the bags, said means comprising a radially and tangentially displaceable and blade-shaped retaining member(s) mounted on the drum and further comprising transverse beams circulating in closed circuit a portion of which mainly coincides with a sector of the periphery of the drum, the actuation of the retaining members taking place through a system of levers cooperating with cams.

14 Claims, 5 Drawing Figures

FIG: 1.
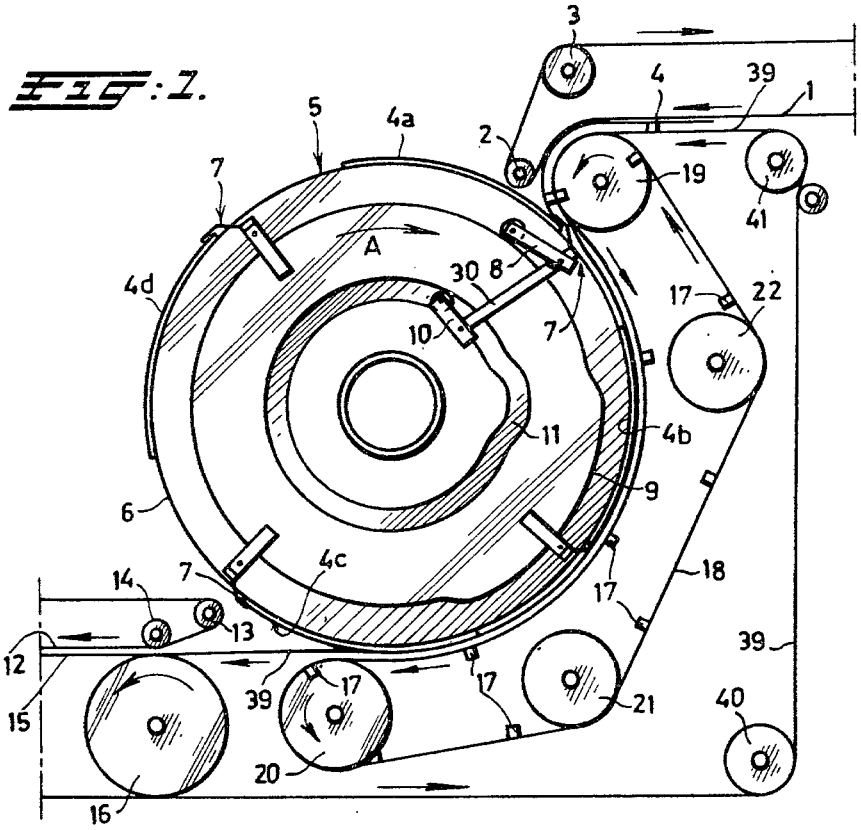
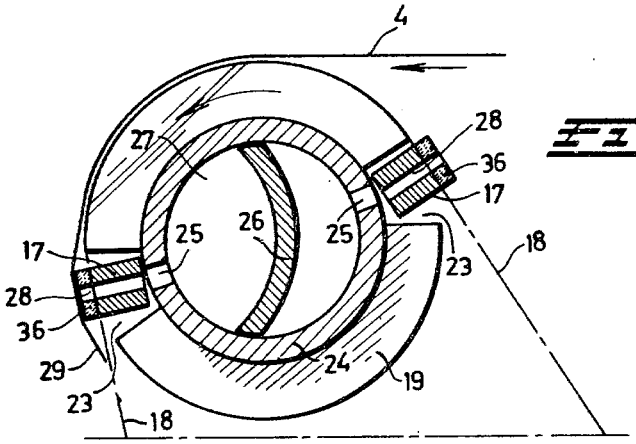
FIG: 2.

DEVICE FOR STACKING THIN-WALLED BAGS

BACKGROUND OF THE INVENTION

The present invention concerns a device for assembling bags of foil material, and in particular a device for stacking bags of thin-walled material comprising a rotatable drum interacting with a supply and with a discharge conveyor, the periphery of said drum comprising assembling locations for stacked bags and retaining means (detents) for these stacked bags.

In order to promote the said stacking of bags there is located behind a fast operating bag machine or a bag cutting machine, a device to assemble said bags or, instead of bags sheets, in proper stacks. When a stack (bundle) comprising a predetermined number of bags or sheets is formed, the stack so formed is discharged. In practice these stacks of bags are generally received between discharge belts the velocity of transfer of which almost corresponds to the circumferential velocity of the drum of the machine.

By means of the supply conveyor the supplied bags are positioned upon a correct location at the circumference of a drum, pins being present upon which the open edge of the bags is pricked, in order to finally assemble a stack of separate bags upon the said pins.

A drum of this type provided with pins running according to a describing line (a generatrix) of the drum, can, however, only be employed when the supply of bags, comprising for example a sealed bottom, is so supplied that—as seen in the direction of travel—the bottom of the bags lies at the trailing end whereby the open side of the bag remains at the front, thus causing a row of small apertures along the open side of the bag to be unimpeding.

Should the bottom of the supplied bags be located in front or at the sides of the drum, then the result will be that an assembly of supplied bags being pricked upon a stacking drum, becomes inconvenient, since in these circumstances the apertures caused by the pins are detrimental for the bags.

Efforts have been made to provide a drum comprising two retaining devices, operating independently with respect to one another, and being positioned upon the circumference of the drum in front of each assembling location (stacking location). Said retaining devices had the shape of, for example, two curved fingers.

The solution as described hereinbefore caused a good and accurate supply and positioning of the bags upon the drum. Nevertheless the said solution offered various disadvantages, one of which was that the supply of a bag to a pack already assembled upon the circumference of the drum, caused the inner finger retaining the front edge of a packet of bags upon a location on the circumference of the drum, to lift the front edge of the bag still to be added. The result of this was that said edge was not put down fast enough upon the stack of bags, so that the operation of the machine was hampered.

The said disadvantage especially occurred in bags manufactured of slack, thin polyethylene foils, but could also be induced by a resistance of air at a high rotational velocity of the relative drum. The raised front edge of the bag lastly supplied impeded the formation of a pack, especially when the operational velocity of the drum was increased.

Owing to the latter feature further efforts have been made to retain the packets of bags upon the circumference of a drum by the use of belts or strings, partially enclosing the drum and having a velocity being adjusted as accurately as possible to the circumferential velocity of said drum.

In practice the fact has emerged that the velocity of the said belts or strings cannot possibly be adjusted appropriately to the circumferential velocity of the drum. Not only a so-called stripping of the lastly supplied bag will occur, but the inner layers of a pack of bags upon the drum may easily shift owing to the very smooth quality of the material from which they are manufactured.

This phenomenon especially occurs when the thickness of the pack of bags increases so that the relative diameter of the drum increases too, thus impeding the adaptability of the strings to the diameter of the drum and the thickness of the pack of bags.

SUMMARY OF THE INVENTION

The present invention aims to provide a certain deceleration in the path of transfer of supplied bags to stacks to be handled, thus causing the total pack to be supplied at a velocity being lower than the velocity employed in a supply of separate bags. In this manner sufficient time is available for a proper handling of the stacks of bags.

It will be obvious that instead of bags other items, for instance sheets, can be stacked in this way. The aim of the present invention is therefore not only to obtain a deceleration in the velocity for stacking bags, but also to provide a completely new device, not suffering from the disadvantages as mentioned hereinbefore, and being able to operate with a very high production velocity.

In accordance with the invention this is attained in that a device is provided of the abovementioned type wherein the retaining members are clenching members traveling in the direction of rotation of the drum and lying entirely and/or partially against the circumference of the drum, whilst they are periodically lifted from the circumference and returned again toward said circumference for positioning a supplied bag upon the circumference of the drum whereas further retaining or clenching members are moving away from the circumference of the said drum for the release of a stack of bags.

It is advantageously achieved hereby that there are, as it were, two groups of clenching members, one group of which comprising transverse beams serving as a clenching member and running parallel with the describing lines of the drum according to a closed path outside the drum, part of this path following the circumference of the drum, whereas the other group in accordance with the invention consists of clenching members passing through orifices within the housing of the drum, said clenching members running in a closed path along the entire circumference of the said drum.

The above-described combination of measures enables separate bags to be easily positioned upon the wall of the drum and stack thereupon, in that the clenching members and part of the transverse beams though running synchronously, are shifted so much in phase, that a transverse beam may interact directly behind a retaining member with the housing of the drum along the rotational direction of the said drum. Hereby it is achieved that the pack or stack of bags is retained properly upon the circumference of the drum without any risk of shifting of said stack when new bags are supplied as yet.

SURVEY OF THE DRAWINGS

FIG. 1 shows a schematical side view, illustrating the composition and the operation of the device in accordance with the invention;

FIG. 2 shows a cross-sectional view of a detail of the locations at which the bags are supplied upon the drum;

DESCRIPTION OF A PREFERRED EMBODIMENT

Figure 3:
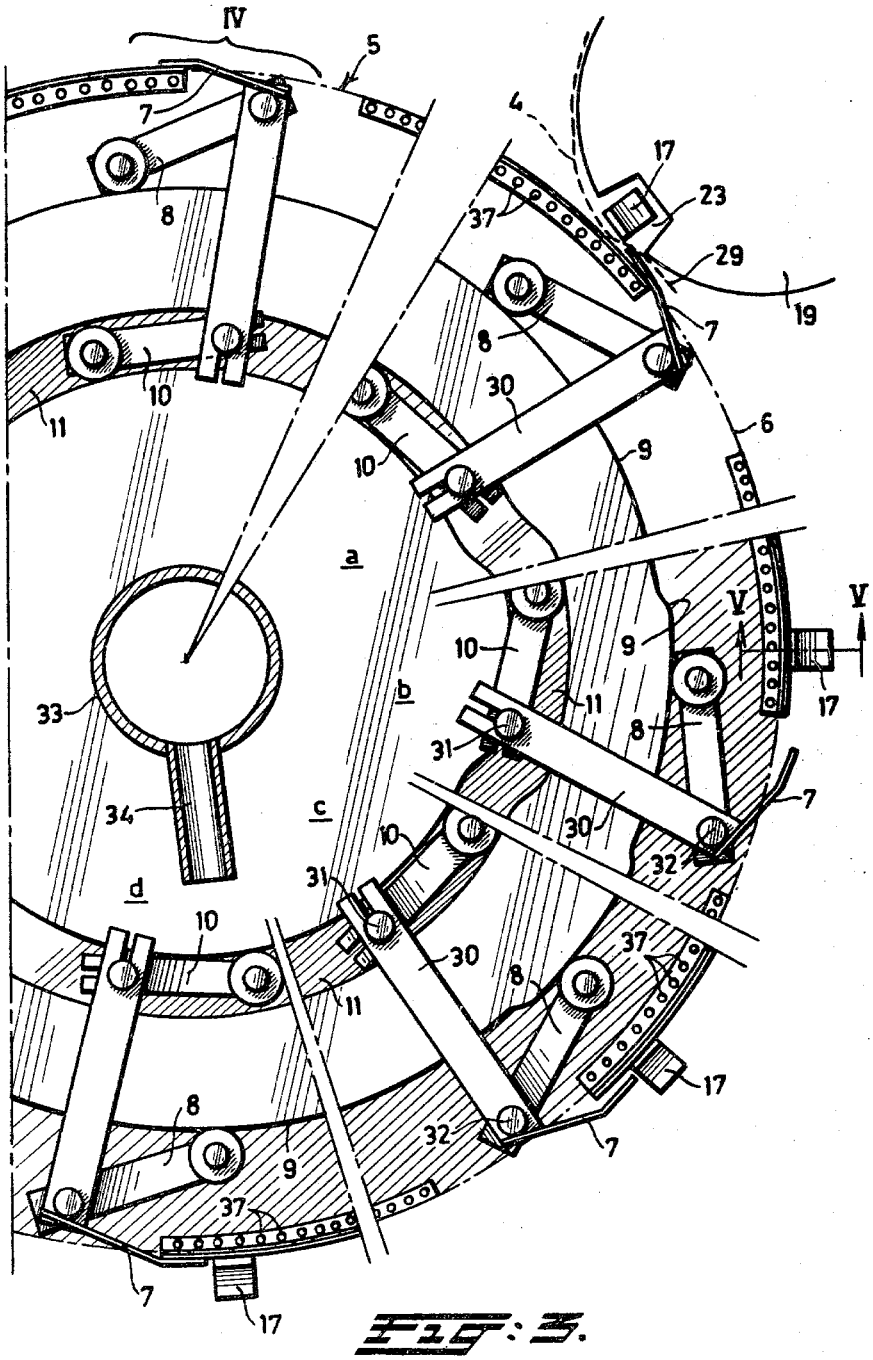
FIG. 3 shows a diagrammatical cross section of parts of a drum, illustrating the subsequent various operational stages of the latter.

The device of FIG. 1 is located directly behind a bag-making machine or a bag-cutting machine (not shown) and to that aim a supply conveyor 1 in the form of belts or strings is guided along return rollers 2 and 3. A second conveyor (not shown) interacts with the supply conveyor 1, so as to support the underside of bags, one of which being referenced with line 4.

The bags are stacked upon the circumference of a drum generally referenced 5 in FIG. 1. Along the circumference 6 of the drum 5 there are four locations for stacking or assembling bags, referenced 4*a*, 4*b*, 4*c* and 4*d*.

The drum 5 rotates in the direction of the arrow A. The stacked bags 4*a*–*d* are retained upon the circumference 6 of the drum 5 by retaining or clenching members, generally referenced 7. The retaining members may be opened or closed at a certain moment because of a bell-crank system, one bell-crank lever 8 of which interacting with a cam disk 9 and a further bell-crank lever 10 interacting with a curved groove 11. The operation of the said levers will be described hereinafter.

As soon as a sufficient number of bags is united to a stack a bell-crank lever will open and release the stack of bags so that same arrives below a discharge conveyor 12, being guided along return rollers 13 and 14. A second conveyor 15 being guided along a return roller 16, interacts with the discharge conveyor 12, so as to support the discharged stacks of bags. The circumferential velocity of the drum 5 corresponds to the velocity of supply of the conveyor 1. The discharge conveyor 12 has an identical velocity in order to avoid a bulging of the stack of bags at the entrance of the conveyor in between the return rollers 13 and 14.

The return roller 14 is capable of a yielding movement when the stack of bags initially arrives below said roller 14. Through a separate adjusting device the velocity of the conveyor 12 and the conveyor 15 interacting therewith, can be decreased.

The clenching members 7 always run simultaneously with the drum 5 because of their being mounted within said drum. Further clenching members 17 co-operate with part of the circumference of the drum 5, in the form of transverse beams (brackets) 17, running parallel with the describing lines (generatrices) of the drum 5. The said transverse beams 17 travel through a closed path, because of their extremities being mounted upon chains 18 guided along return wheels 19, 20, 21 and 22 for an aim to be described hereinafter.

It will be clear that a transverse beam or bracket 17 arriving at the location of the return wheels 20 will leave the circumference 6 of the drum 5, thus releasing the stack of bags from said circumference 6 of the drum 5, after the front edge of the stack of bags is detached from a clenching member 7. The exact manner in which the latter operation will occur, will be described hereinafter, with reference to FIG. 3.

When the chains 18 supporting the transverse beams 17 arrive at the location of the guide wheels 19, said transverse beams 17 fit in recesses 23 (FIG. 3). In between the return wheels 19 of the chains 18 at the ends or extremities of the transverse beams or clenching members 17, there is a cylindrical tube 24, being provided with a row of apertures 25 at the location of the recesses 23. The tube comprises a stationary portion 26 covering part 27 of the internal space within said tube 24. Part 27 is connected with a source of vacuum.

Each beam 17 comprises a row of apertures 28 coinciding with the openings 25 in the tube 24. When tube 24 rotates simultaneously with the guide wheels 19 and an aperture 25 of said tube 24 will arrive at the space 27, then air will be sucked through said aperture 25 but also through the aperture 28, which causes a supplied bag 4 to be sucked firmly against a beam or clenching member 17. This is essential for the positioning of a bag 4 upon the circumference 6 of the drum 5.

FIG. 2 and FIG. 3 show the leading edge 29 of a supplied bag 4. The synchronization of the bag supply and of the beams 17 upon the chains 18 is thus that the edge 29 of a bag 4 always arrives at the front part of a bag 4 already present upon the drum. The beam 17 enabling the leading edge of a bag 4 to be positioned upon the drum is located just behind a clenching member 7, as seen in the direction of rotation of the drum, when said clenching member 7 is so located that all front edges of bags already present upon the drum are being clenched. This situation is illustrated in sector a of FIG. 3. The front edge 29 of the bag 4 just supplied is therefore located above the clenching member 7. The bell-crank lever 8 of the clenching member 7 in said sector is supported by the lowest part of the cam disk 9, as seen in a radial direction. The bell-crank lever 10 of the bracket 30 of the clenching member 7 likewise travels within the curved groove 11 in the region having the smallest radial distance.

It will be self-evident that the front edge 29 of the supplied bag 4 has to be positioned below the clenching member 7. To that aim the bell-crank levers 8 and 10 are controlled by the cam disk 9 and the curved groove 11. In sector b of FIG. 3, wherein the bell-crank lever 8 of sector a is shown in a subsequent stage of travel of the drum, the said bell-crank lever 10 arrives in a raised part of the curved groove 11. The bell-crank lever 8 will hereby lift the clenching member in a radial direction from the stack of bags upon the circumference of the drum 5, whilst the bell-crank lever 10 will swing bracket 30 around the axis 31 so as to withdraw the clenching member 7 tangentially from the stack of bags. Consequently sector b in FIG. 3 shows the most open position of the clenching member 7. The transverse beam 17 thereby presses the newly arrived bag 4 upon the stack already being present.

Since the clenching members 7 have a blade-shape, they prevent the front edge 29 of a supplied bag 4 to be raised, owing to the rotational velocity of the drum 5. A current of air, if any, across the blade-shaped clenching member 7, caused by the rotation of the drum 5, may cause a whirl across the clenching member, pressing the front edge of the lastly clenched bag upon the stack of bags already being present. The said stack of bags remains properly clenched upon the circumference 6 of the drum 5 owing to the pressure of the pressure beam 17.

At a subsequent rotation of the drum 5, the clenching member 7 has to be re-pressed upon the front edge of the stack of bags. To that aim the bell-crank lever 8 runs upon an additional hill of the cam disk 9, thus causing the axis 32 to be slightly rotated, so that the clenching members mounted upon said axis 32 will be radially lifted further outwardly.

In the zone of rotation of the drum 5, referenced in FIG. 3 by sector c, the bell-crank lever 10 moves again toward the part of the curved groove 11, having the least radial distance. The bracket 30 subsequently swings about the spindle 31 and the clenching member 7 moves above the front edge of the stack of bags 4 upon the circumference 6 of the drum 5. In this stage the clenching member is still lifted from the stack of bags in that the bell-crank lever 8 runs upon the highest part of the cam disk 9.

At a further rotation of the drum 5 from sector c in FIG. 3, the bell-crank lever 8 will leave the highest part of the cam disk and will run toward the part having the least radial distance. Consequently the clenching member 7 is pressed upon the front edge of the stack of bags, as is shown in sector d of FIG. 3. In this sector transverse beams 17 upon chains 18 travel about return wheels 20 (FIG. 1) and said beams will now get detached from the circumference 6 of the drum 5, whilst the stack of bags will be retained at its front edge by the clenching member 7. The drum 5 will now rotate further until sector a, as shown in FIG. 3 is reached again by said assembling location and a subsequent bag can be put upon the stack of bags.

A number of rotations of the drum 5 having caused a sufficient number of bags to be stacked upon the assembling locations, an additional controlling mechanism (not shown) is activated, causing the clenching member 7 to be detached in sector d for a discharge of the complete stack of bags to the discharge conveyor 12. The interior of the drum 5 comprises an air conduit 33 provided with a blowing nozzle 34. As soon as a signal is emitted to clenching member 7 to release the stack of bags in said sector d, pressurized air is simultaneously fed into conduit 33 causing the stack of bags to be blown away from the circumference of the drum through the blowing nozzle 34.

During the said stage a shifting of the bags within the stack is made impossible, because of the number of transverse beams 17 upon the chains 18 being a multiple of the number of clenching members 7. Consequently the stacks of bags are retained by two or more transverse beams 17 at a distance being more rearward with respect to the clenching members 7, as seen in the rotational direction of the drum 5. When the trailing end edge of the stack of bags is released, the leading edge of said stack has already arrived below the discharge conveyor 12, in that the transverse beams 17 with chains 18 rotate about the return wheel 20 (FIG. 1).

As soon as the entire stack of bags has arrived below the discharge conveyor 12, the operational velocity of the said conveyor is decelerated causing the stacks to be easily handled at the end of the path of the conveyor 12.

Figure 4:
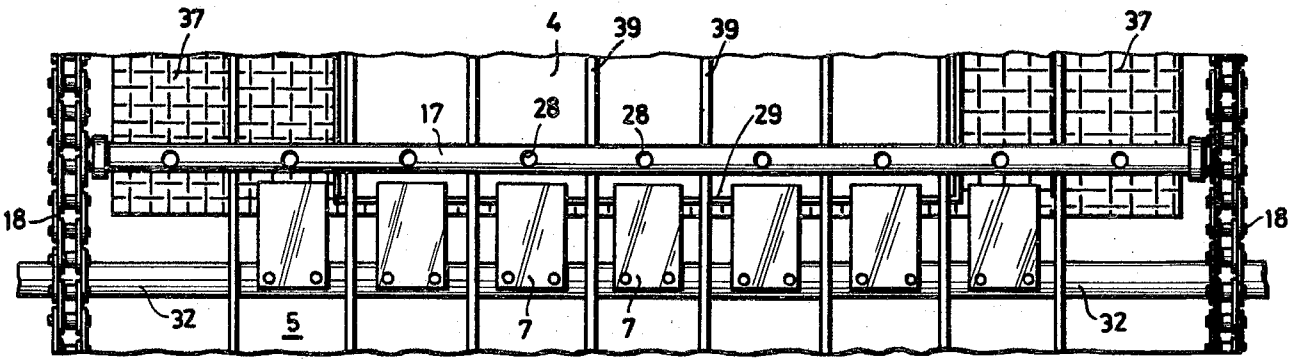
FIG. 4 shows a top view of parts of a drum at the location of the area IV in FIG. 3.
Figure 5:
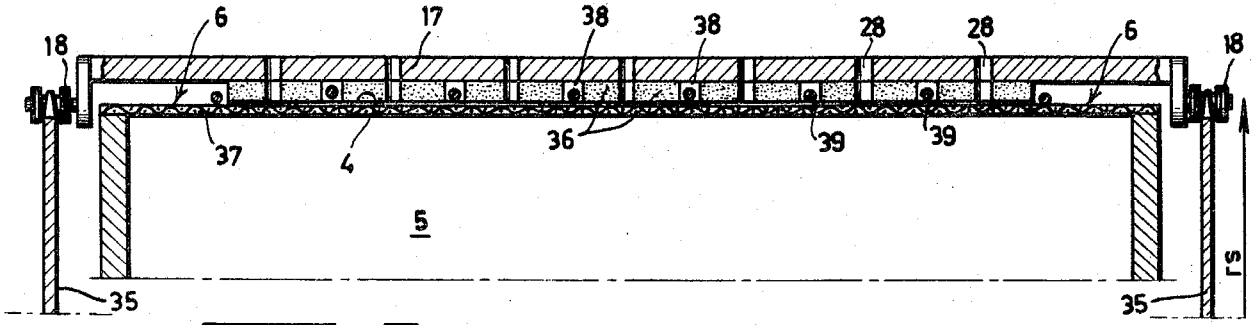
FIG. 5 shows a cross section according to line V—V in FIG. 3.

It will be self-evident that the operational plane of the transverse beams 17, that is the plane first contacting the circumference 6 of the drum 5 and subsequently the increasing stack of bags thereupon has to move accurately synchronous, first with the rotational velocity of the drum 5 and gradually with the rotational velocity of the increasing stack of bags being present thereupon. This will be elucidated hereinafter with reference to FIGS. 4 and 5.

As described hereinbefore, the ends of the transverse beams 17 are mounted to chains 18. The chains are guided about chain wheels 35 disposed at either side of the drum 5 and rotating synchronously with the drum 5. The pitch circle of these chain wheels 35 accurately corresponds to the outer periphery of the circumference 6 of the drum 5. From this it follows that the radius of the pitch circle entirely corresponds to the radius of the drum. Because of the increasing growth of the stack of bags, the transverse beams 17 are provided with resilient cushions 36. The apertures 28 for tightly sucking a bag during the supply of the latter, extend through said cushions 36. The cushions 36 may be flattened by the thickness of the stack of bags so that a clenching of the stack of bags is increased progressively with its growing thickness.

Shifting of the bags within the stack, especially a shifting of the middle bags in this stack is furthermore prevented in that the housing of the drum at the location of the assembling locations for bags, is made of a woven wire-netting. This causes an embossment upon the circumference of the drum so that a certain design is pressed in the bags below the transverse beams 17, which also prevents a shifting of the relative bags. The assembling locations of woven wire-netting are referenced 37 in FIGS. 3, 4 and 5. It will be obvious that an embossment differing from the one as shown in said Figures, can be applied at those assembling locations but the use of woven wire-netting is preferred in connection with the blowing away of the stack of bags, when a current of air is emanated from the blowing nozzle 34. The cushions 36 are provided with interruptions 38 as seen in the direction of the describing line of the said cushions; the clenching members 7 are also provided with interruptions extending toward the same direction. Said interruptions serve for a passage of strings 39 which slightly move together with the circumference 6 of the drum 5, but which cannot possibly shift the bags, due to their minor contacting pressure. They only serve to prevent a rise of the front edges of the bags. The said strings 39 travel about a return roller 16, a return wheel 19, and about return rollers 40 and 41 (FIG. 1). A similar system of strings can also be applied upon the non-active part of the drum, in order to prevent an undesired turbulence in the trailing ends of the bags, due to centrifugal forces. The latter not forming part of the subject matter of the present invention, said strings have not been illustrated in FIG. 1 in the free part of the drum 5.

The upper horizontal part of the strings contributes to a support of the bags 4 being supplied by the conveyor 1. Strings of this type may travel about guide wheel 41, parallel with the path of the supply conveyor 1, for the support of bags. Said strings neither forming part of the subject matter of the present invention, they have not been illustrated in the drawings.

What is claimed is:

1. In a device for assembling bags made of thin-walled material comprising (a) a rotatable stacking drum which cooperates with a supply means and a discharge means, and which has one or more locations on the periphery of the drum for stacking material;

(b) primary clenching means for retaining stacked material against the periphery, the primary clenching means traveling in the rotational direction of the drum; and (c) secondary clenching means which travel in a closed path outside the drum, part of the path following a portion of the periphery of the drum; the improvement comprising (i) first primary clenching movement means for moving the primary clenching means tangentially relative to the stacking drum periphery between a first position adjacent a location for stacking material and a second position tangentially separated from said location; and (ii) second primary clenching movement means for moving the primary clenching means radially relative to the stacking drum periphery between a first position pressing against the drum periphery or stacked material and a second position radially separated from the drum or stacked material; such that the movement of the primary clenching means in each of the radial and tangential directions is separately controllable and occurs sequentially, whereby the primary clenching means moves, in sequence, tangentially of the drum periphery, and then radially outwardly from the drum periphery.

2. The device of claim 1 wherein each of the first and second primary clenching movement means comprises a cam surface and a cam follower operatively connected to the primary clenching means.

3. The device of claim 2, wherein both cam surfaces are annular surfaces generally concentric to, and within the periphery of, the drum.

4. The device of claim 3, comprising (b) a plurality of primary clenching means and a supporting rod, the primary clenching means being fixedly attached to the supporting rod which has its axis extending parallel to the axis of the drum; and wherein (i) the first primary clenching movement means comprises a first bell crank lever fixedly connected at one end to the supporting rod and at its other end to the first cam follower; and (ii) the second primary clenching movement means comprises a second bell crank lever connected at one end to the second cam follower; and a connecting member fixedly connected at one end to the supporting member and at its other end is pivotably and slideably connected to the second bell crank lever.

5. The device of claim 1 wherein the periphery of the drum has openings for the passage of primary clenching means therethrough.

6. In a device for assembling bags made of thin-walled material comprising (a) a rotatable stacking drum which cooperates with a supply means and a discharge means, and which has one or more locations on the periphery of the drum for stacking material;

(b) primary clenching means for retaining stacked material against the periphery, the primary clenching means traveling in the rotational direction of the drum; and (c) secondary clenching means which travel in a closed path outside the drum, an operative curved portion of the path being concentric to and adjacent a portion of the periphery of the drum; the improvement wherein the secondary clenching means comprises (i) at least one resilient member each providing a transverse clenching surface which upon being pressed is resiliently movable inwardly;

(ii) an axially extending beam member supporting the resilient member at a location adjacent to the drum such that the clenching surface of each resilient member is in contact with the periphery of the drum or of any stacked material on the drum periphery when the secondary clenching means is located on the operative curved portion of the path; and (iii) drive means connected to the beam member for moving the clenching surfaces along the operative curved portion of the path at an angular velocity equal to the rotational velocity of the drum;

each clenching surface being resiliently radially movable relative to the drum and biased towards the drum periphery, such that the clenching surface is depressed radially away from the drum periphery as the thickness of stacked material on the drum increases, so that the portion of the clenching surface in contact with the uppermost stacked material is driven at a tangential velocity that remains equal to the tangential velocity of the outermost stacked material, as the thickness of stacked material changes.

7. The device of claim 6 wherein the transverse clenching surface comprises a plurality of resilient cushions.

8. The device of claim 7, wherein the beam member is a cushion support rod, the axis of which extends parallel to the axis of the drum and having mounted thereon the resilient cushions, and comprising in addition driving gear wheels, having axes coincident with the axis of the drum and having a pitch circle equal to the periphery of the drum; and chains operatively connected between the gear wheels and support rods for driving the support rods.

9. The device of claim 8 wherein the number of cushion support rods is a multiple of the number of locations for stacking material on the drum such that more than one cushion support rod interacts with each location for stacking material.

10. In a device for assembling bags made of thin-walled material comprising (a) a rotatable stacking drum which cooperates with a supply means and a discharge means, and which has one or more locations on the periphery of the drum for stacking material;

(b) primary clenching means for retaining stacked material against the periphery, the primary clenching means traveling in the rotational direction of the drum; and (c) secondary clenching means which travel in a closed path outside the drum, an operative curved portion of the path being concentric to and adjacent a portion of the periphery of the drum; the improvement comprising (i) first primary clenching movement means for moving the primary clenching means tangentially relative to the stacking drum periphery between a first position adjacent a location for stacking material and a second position tangentially separated from said location; and (ii) second primary clenching movement means for moving the primary clenching means radially relative to the stacking drum periphery between a first position pressing against the drum periphery or stacked material and a second position radially separated from the drum or stacked material; such that the movement of the primary clenching means in each of the radial and tangential directions is separately controllable and occurs sequentially, whereby the primary clenching means moves, in sequence, tangentially of the drum periphery, and then radially outwardly from the drum periphery; and wherein the secondary clenching means comprises (iii) a transverse clenching surface for contacting the periphery of the drum or any stacked material on the drum periphery when located on the operative curved portion of its path, said surface extending longitudinally along the drum periphery; and (iv) drive means connected to the surface for moving the clenching surface along the operative curved portion at an angular velocity equal to the rotational velocity of the drum;

the clenching surface being resiliently, radially moveable relative to the drum and being biased towards the drum periphery; such that the clenching surface is resiliently depressed as the thickness of stacked material on the drum is increased, so that the tangential velocity of the surface in contact with stacked material remains equal to the tangential velocity of the outermost stacked material as the amount of stacked material changes.

11. The device of claim 10 wherein the primary and secondary clenching means rotate synchronously but are shifted in phase such that the secondary clenching means interacts with the surface of the drum or any stacked material thereon shortly after the primary clenching means interacts with the surface.

12. The device of claim 10 wherein the locations for stacking material comprise embossed surfaces on the periphery of the drum.

13. The device of claim 12 wherein the embossed surfaces comprise woven wire netting.

14. In a device for assembling bags made of thin-walled material comprising (a) a rotatable stacking drum which cooperates with a supply means and a discharge means, and which has one or more locations on the periphery of the drum for stacking material;

(b) primary clenching means for retaining stacked material against the periphery, the primary clenching means traveling in the rotational direction of the drum; and (c) secondary clenching means which travel in a closed path outside the drum, part of the path following a portion of the periphery of the drum; the improvement wherein the secondary clenching means comprises (i) a plurality of resilient cushions each having a clenching surface which is resiliently radially moveable relative to the drum and biased towards the drum periphery, for contacting the periphery of the drum or any stacked material on the drum periphery, said clenching surface extending longitudinally along the drum periphery; and (ii) at least one cushion support rod, the axis of which extends parallel to the axis of the drum and having mounted thereon the resilient cushions, driving gear wheels, having axes coincident with the axis of the drum and having a pitch circle equal to the periphery of the drum, and chains operatively connected between the gear wheels and support rods for driving the support rods at a rotational velocity equal to the rotational velocity of the drum; such that the clenching surface is resiliently depressed as the thickness of stacked material on the drum is increased, so that the tangential velocity of the clenching surface in contact with stacked material remains equal to the tangential velocity of the outermost stacked material as the thickness of stacked material changes.

* * * * *